US006339854B1

(12) United States Patent
Amendt

(10) Patent No.: US 6,339,854 B1
(45) Date of Patent: Jan. 22, 2002

(54) STEAM CABINET AND METHOD OF MANUFACTURE

(75) Inventor: Darcy S. Amendt, Edmonton (CA)

(73) Assignee: SPA Logic Inc., Thorsby (CA)

( * ) Notice: Subject to any disclaimer, the term of this patent is extended or adjusted under 35 U.S.C. 154(b) by 0 days.

(21) Appl. No.: 09/666,082

(22) Filed: Sep. 21, 2000

(51) Int. Cl.[7] ..... A61H 33/06
(52) U.S. Cl. ..... 4/524; 4/532; 607/83
(58) Field of Search ..... 4/524, 526, 528, 4/531, 532; 607/81, 83, 84

(56) References Cited

U.S. PATENT DOCUMENTS

| | | | | | |
|---|---|---|---|---|---|
| 1,158,382 | A | * | 10/1915 | Leslie | 4/528 |
| 3,290,697 | A | * | 12/1966 | Anderson | 4/532 |
| 3,721,802 | A | | 3/1973 | Chrisman | |
| 4,031,573 | A | | 6/1977 | Romanoff | |
| 4,137,574 | A | | 2/1979 | Collins | |
| 4,277,855 | A | | 7/1981 | Poss | |
| 4,340,981 | A | * | 7/1982 | Vanags | 4/524 |
| 4,565,188 | A | * | 1/1986 | Hardie | 4/524 |
| 4,805,293 | A | | 2/1989 | Buchser | |
| 5,023,926 | A | | 6/1991 | Arnold | |
| 5,425,753 | A | | 6/1995 | Wege et al. | |
| 5,561,880 | A | | 10/1996 | Allen et al. | |
| 5,713,309 | A | | 2/1998 | Higashi | |
| 5,872,890 | A | | 2/1999 | LaCombe | |
| 6,055,684 | A | | 5/2000 | Azuma | |

OTHER PUBLICATIONS http://www.steamembrace.com print date: Jun. 9, 2000.
http://www.steamembrace.com/surround/index.htm print date: Jun. 9, 2000.
http://www.steamembrace.com/commercial/index.htm print date Jun. 9, 2000.
http://www.sallybeauty.com/Steam/Embrace.htm print date: Jun. 9, 2000.

* cited by examiner

*Primary Examiner*—Charles R. Eloshway
(74) *Attorney, Agent, or Firm*—Sean W. Goodwin

(57) ABSTRACT

A personal steamer comprising an assembly of three pieces: a base tub and liner tub and a lid. The liner tub is body-shaped to form a foot, a seat, a back and side walls forming a steam enclosure. A lid, hinged at the foot, can be pivoted to a vertical, low stress vertical position, or closed for use. The liner tub is formed of ABS and reinforced with fiber-glass on its underside where it is protected from the steam. The liner tub is fitted into the base tub and foamed together, forming a base assembly. Steam is conducted through a fitting in the base tub and through a conduit to a horn outlet at the user's feet. The steam is discharged away from the user and towards the lid, deflecting back to into the enclosure. U-shaped conduits and fans recirculate steam in the enclosure. A portable steam generator is coupled with the cabinet for providing constant temperature steam very quickly. A low volume boiler, having a V-shaped bottom and a gravity water feed ensures minimum water levels and minimum water volumes. A vacuum-lock water reservoir provides water supply and fine level control.

9 Claims, 10 Drawing Sheets

STEAM CABINET AND METHOD OF MANUFACTURE

FIELD OF THE INVENTION

The current invention relates to personal steam cabinets or saunas and their method of manufacture, more particularly to the arrangement and multi-piece manufacture of the base and the means for recirculation or steam within the cabinet.

BACKGROUND OF THE INVENTION

A number of devices are known to provide a steam bath or sauna in a compact and personal form. Simply, a steam enclosure is provided in which a user resides. There is provided means for entry and means for generation of steam. One additional advantage of a personal steam cabinet is that the user's head projects outside of the top of the cabinet and enables breathing of fresh cool air.

Despite the appeal and therapeutic benefits of personal steam cabinets, the present designs have various shortcomings. Some of these shortcomings include the broad areas of: maintaining cabinet integrity under in the warm temperature regime; both structural and the environment; heat control; uniformity of heat application and user comfort support; and the need for replenishment of the water supply.

Regarding the structure, other rigid enclosure clamshell designs utilize side hinge placement. When open, the weight of the lid bearing of the hinge can damage the lid and cause the hinge structure to failure prematurely. Under the prolonged application of steam heat and if subsequently left in the open position, the lid relaxes and deforms under gravity into a more oblong shape. Further, or alternatively, the hinges pull free from the lid or base due to the mechanical advantage. Either of the shape change, or movement in the hinges result in an improperly fitting lip and base portion. When the cabinet changes its shape or the door shifts, the seal is jeopardized, causing steam and condensation to escape. The same problems occur to a lesser extent with models having a split lid and, while sagging is less of an issue, the extra peripheral area requires additional seals and steam and moisture leakage increases proportionately.

Further, the usual materials and method of manufacture utilize fiberglass resins or otherwise urea-based construction. Exposing these types of materials to prolonged steam exposure and temperature ultimately cause styrene or urea to be released, both of which are unpleasant; both due to its odor and when it comes in contact with the now open pores of the user.

Regarding the steam experience for the user, it is common to have a great disparity in temperature between the upper and lower regions of the cabinet. Additionally, when the steam condenses it tend to pool unpleasantly about the user's feet.

The supply of steam has been associated with various disadvantages including the need is some cases for plumbed supply, or in the case of portable units, small reservoirs and the need for constant refilling. In the fill-and-evaporate systems, as the steam boilers empties, the danger of scalding heightens as the steam becomes hotter.

The applicant's cabinet and steam supply avoid the above mentioned problems and provide a convenient and environmentally sound and pleasant steam cabinet.

SUMMARY OF THE INVENTION

In a preferred form of the invention, a personal steam cabinet, formed of non-volatile ABS plastic, is manufactured as an assemblage of three-pieces: a base tub, a liner tub and a lid. The liner tub is fitted with various operational and structural features and then is installed into the base tub. The lid is hinged at the foot of the base tub. The liner tub supports a partially reclining user, and when the lid is closed, the liner tub forms a steam enclosure about the user. The flexible ABS liner tub is reinforced with fiberglass, the reinforcing being located on the liner tub's underside so as to isolate it from the steam. Hot spots are avoided through fan-equipped, U-shaped recirculation conduits with inlet and outlets being located in the liner tub for access to the steam enclosure. A horn structure at the foot of the liner tub is connected via steam conduit to a steam inlet on the base tub. The horn is fitted with a plurality of steam outlets which are directed towards the lid so as to avoid direct contact of hot steam and the user and to use the lid to deflect the steam back into the enclosure.

In a preferred combination, the above steam cabinet is combined with a portable steam generator, connected by a steam conduit and a control line. The control line provides low voltage power to the onboard fans and for transmitting a temperature signal from a temperature probe in the cabinet.

Preferably, the portable steam generator is a gravity water feed system which slowly provides water under vacuum level control from a water reservoir to a boiler, the level control ensuring only a minimum volume of water which barely covers the electric heater. The minimum water volume heats very quickly and the level control ensures constant temperature of the generated steam.

Accordingly, in one broad aspect, a personal steam cabinet is provided comprising a base tub forming a cavity and having a first periphery, a liner tub forming a steam enclosure and having a generally W-shaped, body-contoured inside lounge portion, the lounge portion being fitted with one or more U-shaped steam conduits each having a outlet and an inlet communicating with the enclosure, the liner tub being insertable into the cavity in the base tub and having a second periphery which mates and seals to the first periphery when so inserted so as to form a base assembly having foot and a head; a fan or fans for inducing flow through each U-shaped steam conduit to recirculate steam in the enclosure; a steam supply conduit extending from the base tub to the lounge portion for conducting and discharging steam into the enclosure; and a closable lid having a third periphery which mates with the second periphery when the lid is closed and substantially sealing the enclosure, the lid having a foot and a head adjacent the foot and head of the base assembly respectively, the lid's head having a cutout for permitting passage of a user's head.

In another broad aspect of the invention, a method of manufacturing the personal steamer comprises the steps of: providing a base tub; providing a liner tub forming a steam enclosure having a body-supporting lounge topside and an underside; installing one or more steam enclosure recirculation conduits to the underside of the liner tub; installing a steam supply conduit between the liner tub and the base tub; fitting the liner tub into the base tub and sealing them together to form a base assembly having a foot, a head and an enclosure periphery; and installing a lid having a foot, a head and a periphery, the lid being hinged at the foot of the base assembly for operation between two positions, the lid periphery sealing to the base assembly's periphery in a first closed position and the lid permitting access to and from the steam enclosure in the second open position.

More preferably, the personal steamer further comprises a portable steam generator connected to the steam supply conduit, the generator having a boiler with a heater immersed in a shallow, level-controlled water supply, the level of the water supply being controlled using a gravity fed, vacuum-locked water reservoir and a fan for directing the steam to the steam supply conduit.

In a more particular aspect of the invention, the portable steam generator comprises a dish into which a neck of a water reservoir is immersed so as to form a vacuum-lock and gravity feed of water from the reservoir; a boiler having a bottom, side walls, a freeboard volume and an electrical immersion heater, the heater positioned adjacent the bottom and the side walls constricting the volume about the heater; a conduit between the dish and the boiler, the elevation of the dish being such that the minimum volume of water is maintained in the boiler to immerse the heater; and a fan for directing air through the freeboard of the boiler to conduct steam to a steam supply conduit.

DETAILED DESCRIPTION OF THE PREFERRED EMBODIMENT

Steam Cabinet

Figure 1:
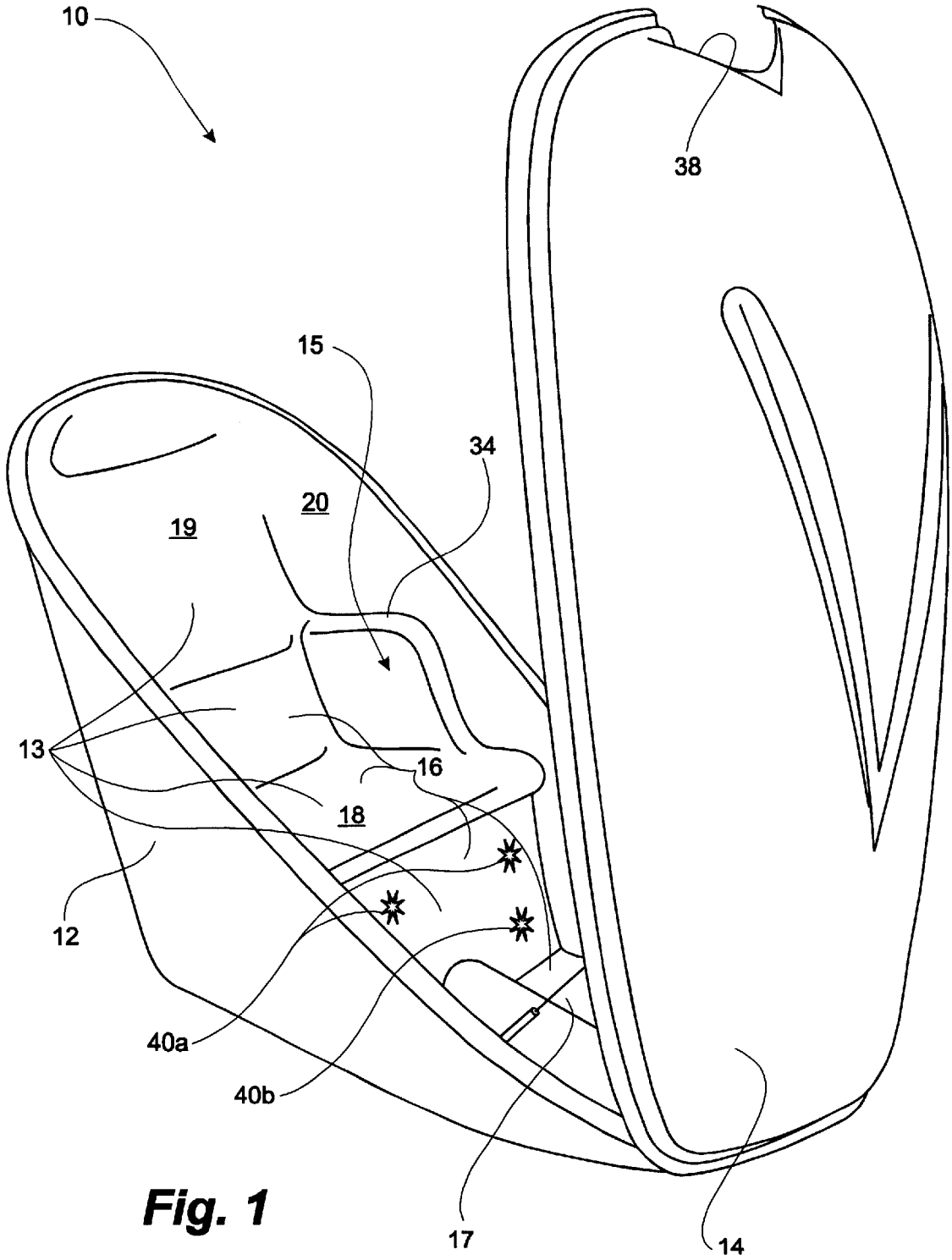
FIG. 1 is a perspective view of the assembled personal steamer with the lid in the fully opened position.
Figure 2:
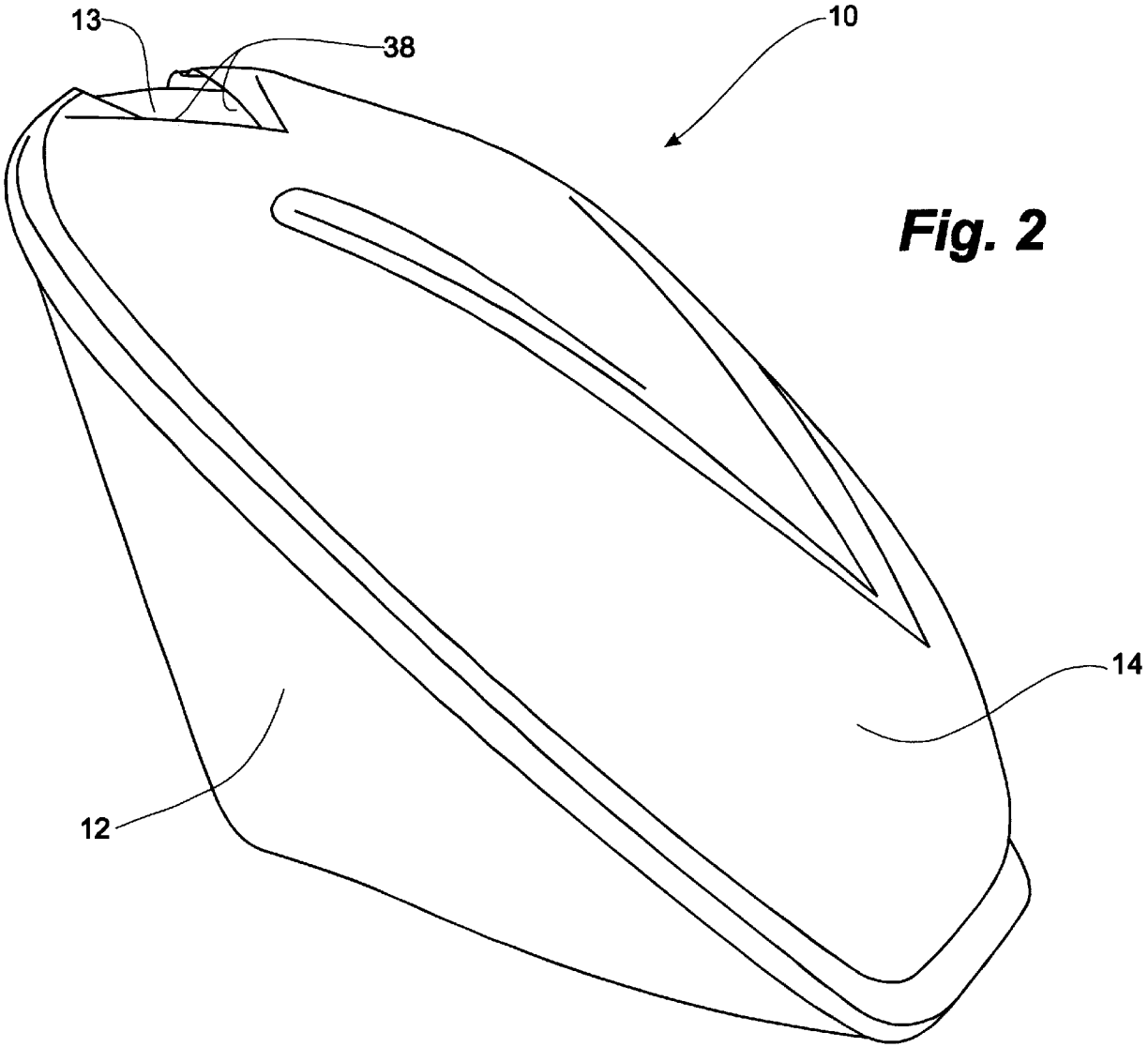
FIG. 2 is a perspective view of the assembled personal steamer of FIG. 1 with the lid in the closed position.
Figures 8A, 8B:
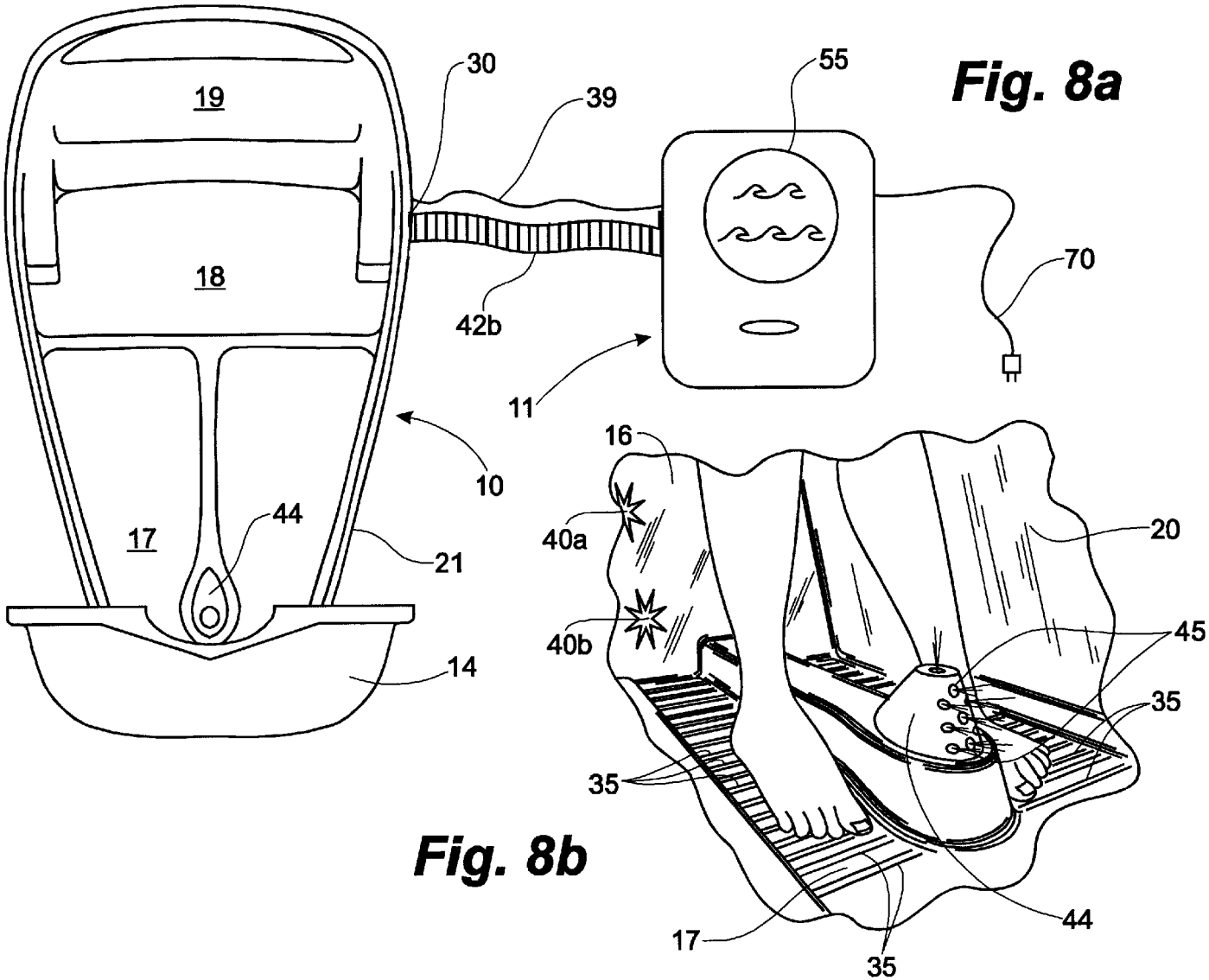
FIG. 8*a* is a top view of the personal steamer in combination with a portable steam generator.
FIG. 8*b* is a partial perspective view of a user's feet resting at the foot of the base assembly and with steam issuing from the horn.

Having reference to FIGS. 1 and 8*a,* the present invention comprises a personal steam cabinet 10, its method of manufacture and a portable steam generator 11 for use therewith.

The cabinet 10 comprises three parts: a base tub 12, a liner tub 13, and a lid 14. The concave liner tub 13 forms a steam enclosure 15. The topside of the liner tub comprises a generally W-shaped lounger portion 16, which is body-contour formed and slightly reclining to comfortably support a person or user sitting therein. Accordingly, the lounger has a foot 17, a seat 18, a back 19 and side walls 20.

Figure 3A:
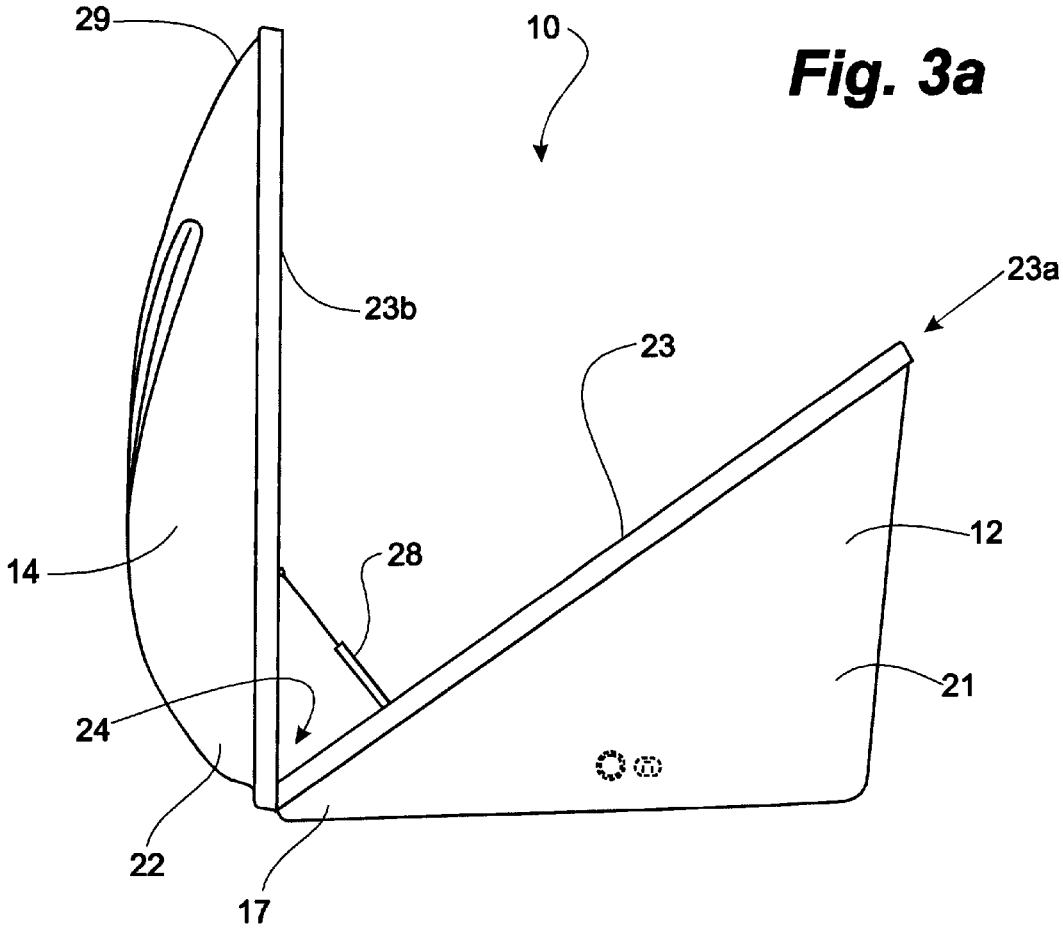
FIGS. 3*a* and 3*b* are both left side views of the personal steamer of FIG. 1, with the lid in the opened and closed positions respectively.
Figure 3B:
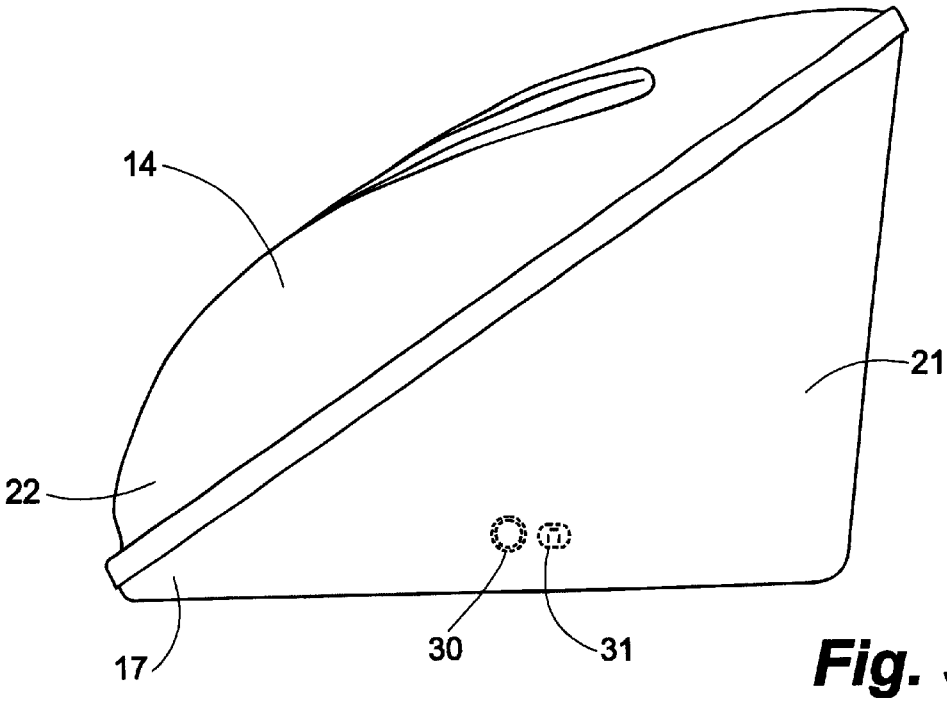

Referring to FIGS. 3*a* and 3*b,* the concave base tub 12 has a substantially rectangular footprint and forms a cavity into which auxiliary equipment is fitted and into which the liner tub 13 is installed for forming a base assembly 21. The lid 14 has a foot 22 and a head 29 and is pivotally connected or hinged at its foot to the base assembly. A cutout 38 is provided at the head 29 of the lid for passing the user's neck and head.

The assembled base assembly has a lip or periphery 23 rising diagonally from a foot to a head.

Figure 4:
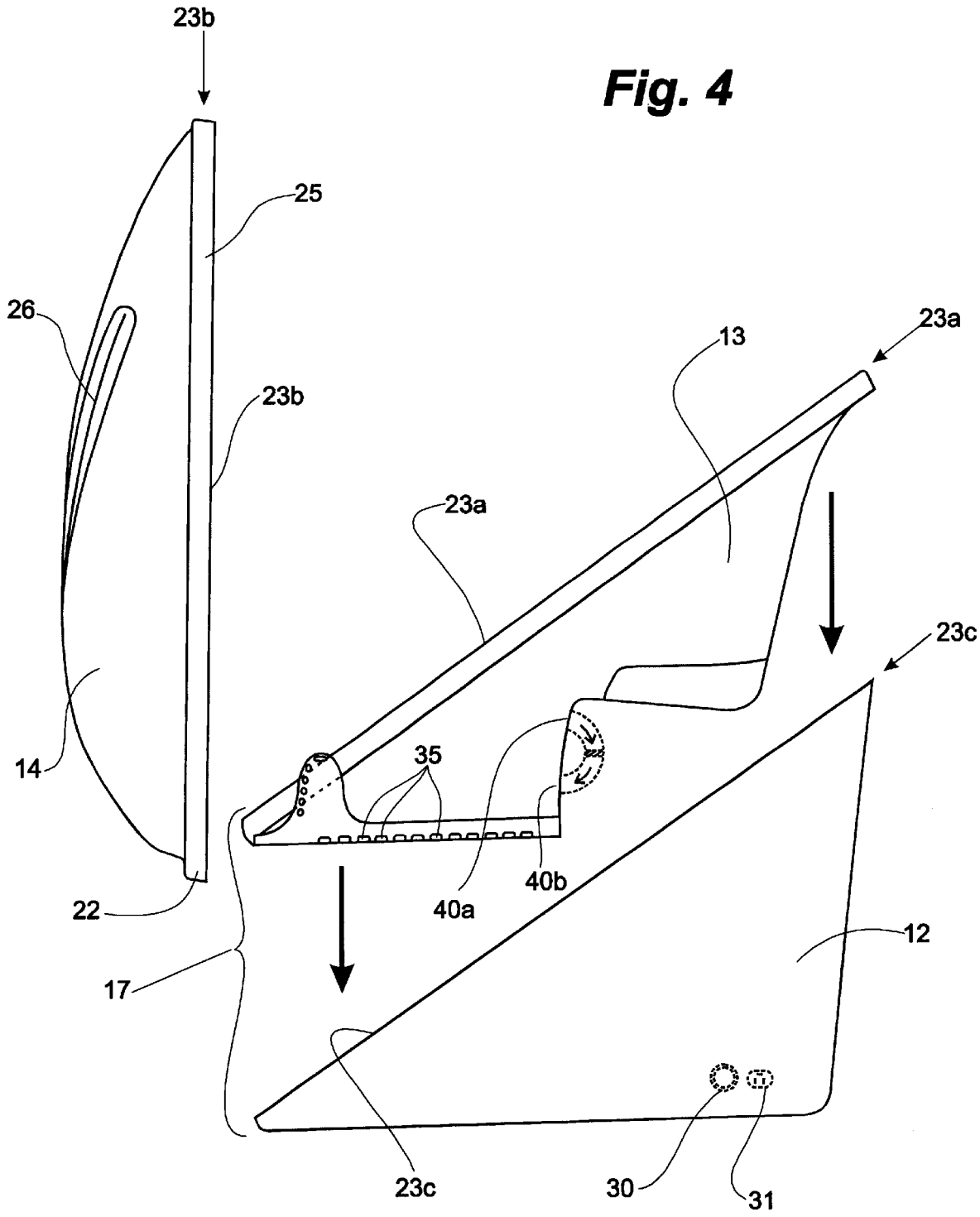
FIG. 4 is an exploded view of a three-piece embodiment of the personal steamer illustrating the lid, the liner tub and the base tub.

The cabinet 10 is provided with a steam inlet 30 and an electrical supply 31. Referring to FIG. 4, the cabinet's multi-piece construction permits the installation of various steam-sensitive enhancements within the protected portions, yet still maintain and low maintenance surfaces.

The lid 14 is designed with a foot hinge system and thus offset weight bearing and its associated structural problems are eliminated. The hinge 24 (not detailed) is secured to the foot 17 of the base assembly 21 and to the foot 22 of the lid 14. The lid 14 has a periphery 23*b* and is formed with an overlapping lip 25, which forces the lid to self-center in relation to the periphery 23 of the base assembly. Gravity helps the lid's periphery 23*b* seal on the entire periphery 23.

The lid 14 is formed of ABS (acrylonitrile butadiene styrene) and thereby avoids the urea emission problems. A V-shaped groove 26 is formed in the lid 14 to provide additional structural integrity to the otherwise unreinforced lid. The lid 14 remains as unreinforced ABS so that it is easily cleaned.

Figure 5A:
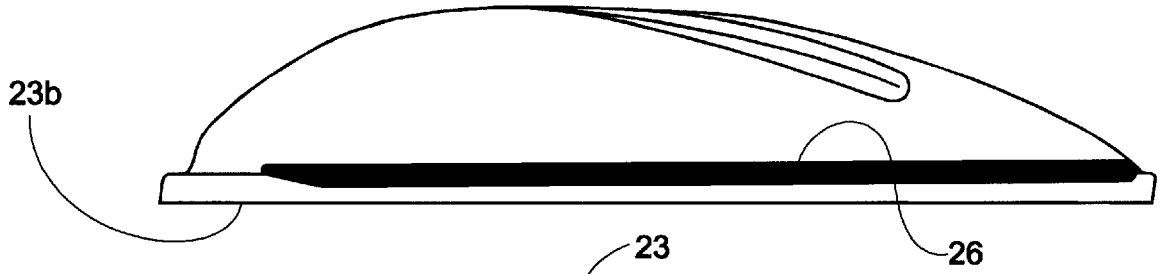
FIGS. 5*a* and 5*b* are side and plan views respectively, of the lid of FIG. 4 with the drip lip illustrated as though the lid were transparent.
Figure 5B:
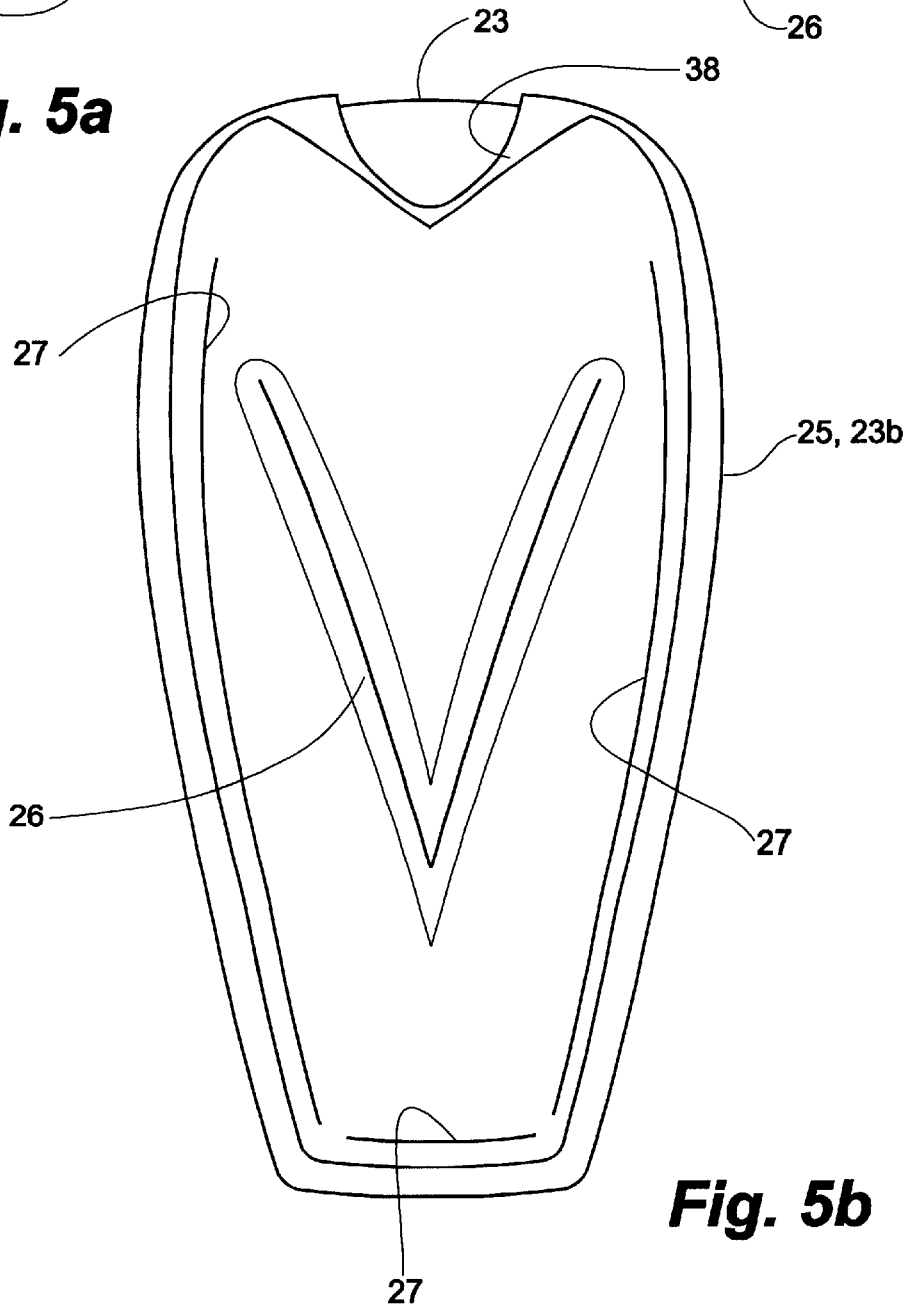

Turning to FIGS. 5*a* and 5*b,* an internal drip lip 27 is attached to the inside of the lid 14 and offset inwards from most of its periphery 23*b.* The drip lip 27 forces condensation to be directed internally to the base assembly's periphery 23 and to collect in the bottom or foot 17 of the cabinet 10 allowing for easy clean up rather than drip outside on the floor or carpet. The drip lip 27 also minimizes opportunity for direct steam escape as it serves to direct most of the steam past the seal and back into the environment. Small hydraulic rams 28 control opening and closing of the lid 14, restricting the maximal range of opening to a vertical position and also to prevent lid-slamming incidents.

The base assembly 21 further solves several of the problems associated with the prior art cabinets.

Figure 6A:
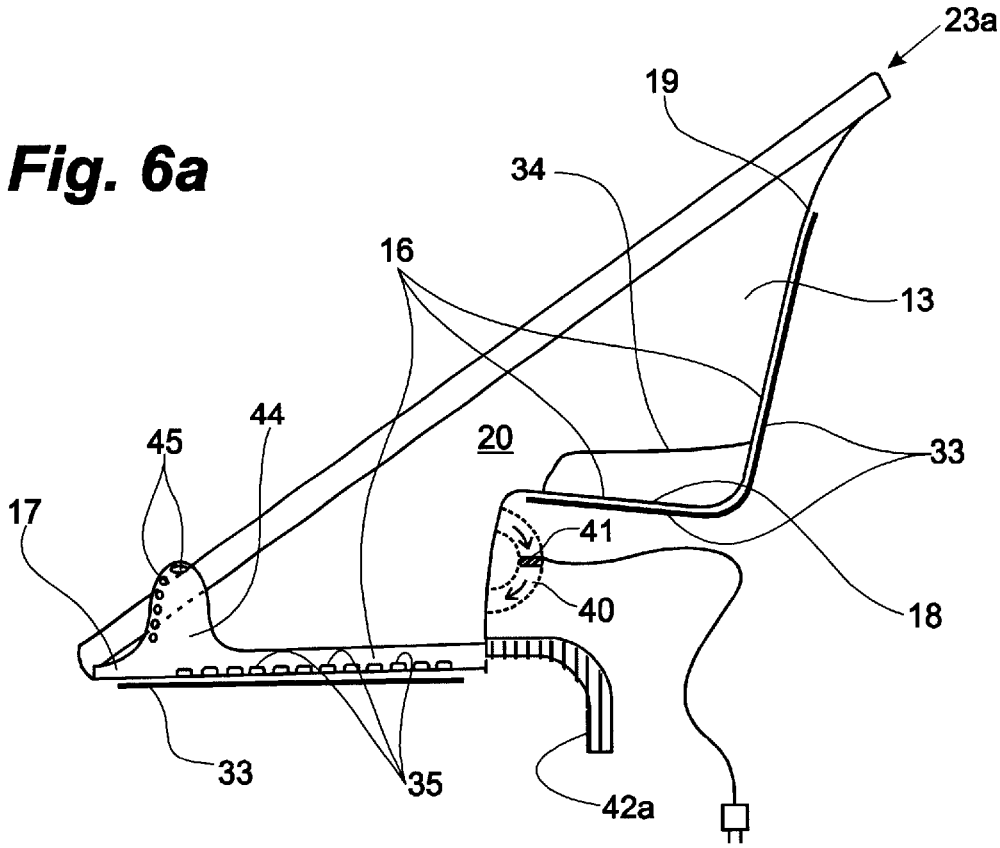
FIG. 6 is a side view of the liner tub with the lounge portion visible through the side walls.
Figure 6B:
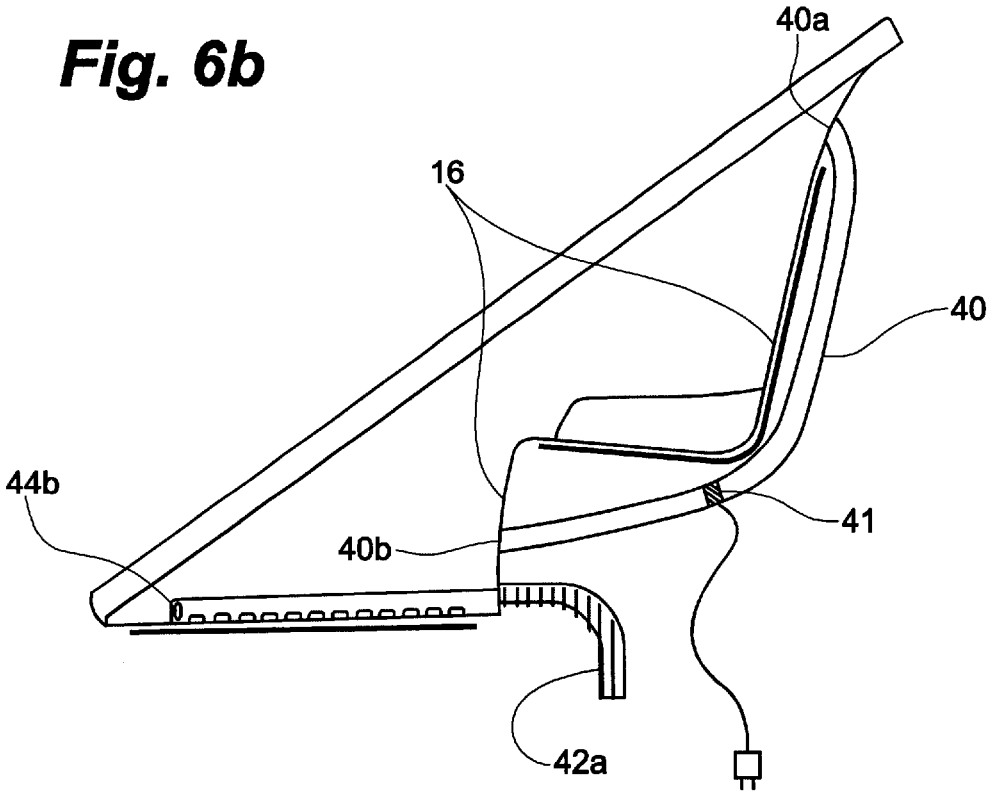
Figure 7:
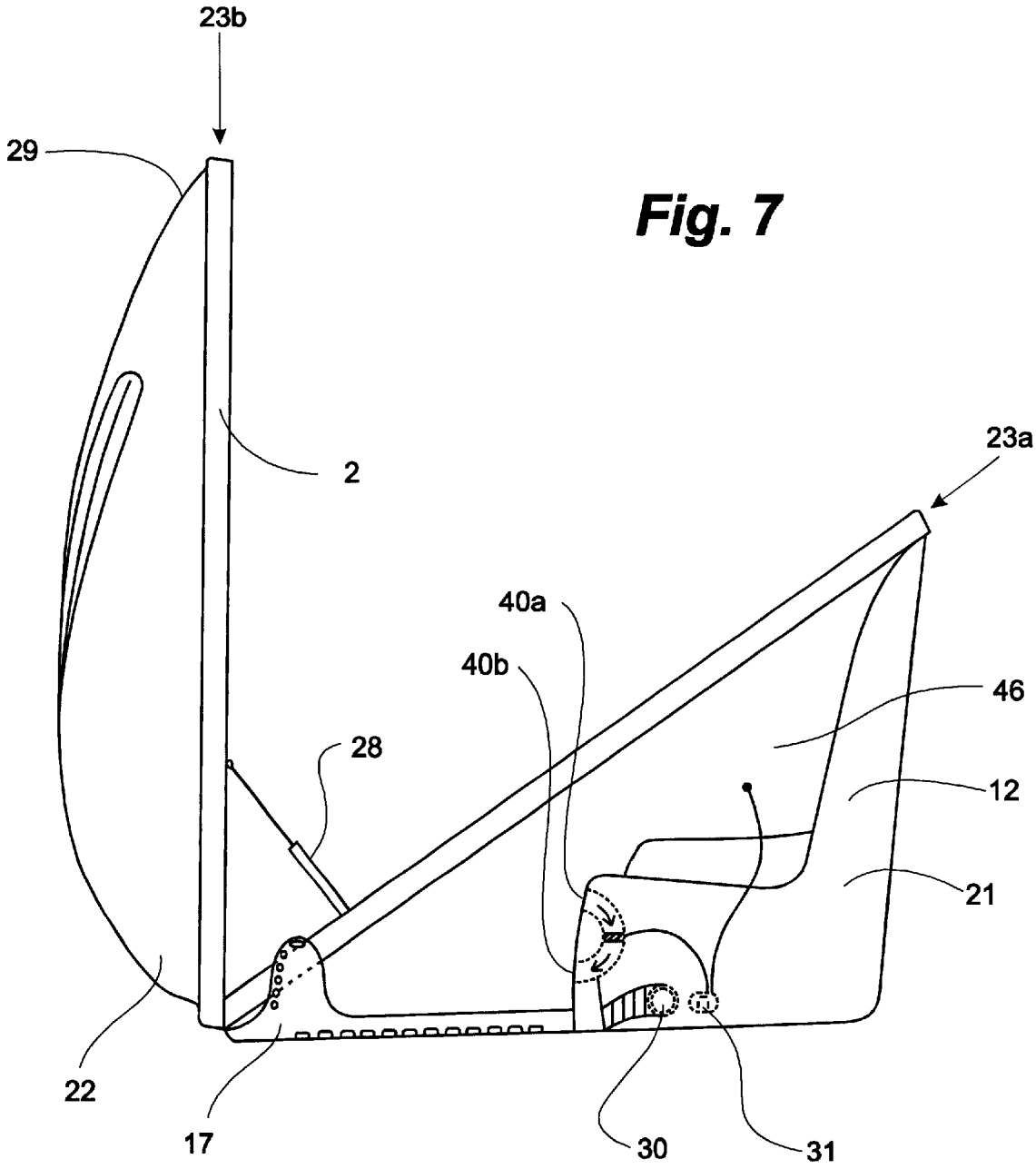
FIG. 7 is a side cross-sectional view of the base tub showing the liner tub installed therein and the lounge portion visible therethrough.

Referring to FIGS. 6 and 7, the liner tub 13 is also formed primarily of ABS and thereby avoids the urea emission problems. However, in achieving a balance between strength and weight, the typically 6 mm inch thick ABS itself is generally not strong enough to rigidly support a person under operating conditions. Accordingly, the lounger portion 13 of the liner tub 13 requires reinforcement 33, such reinforcement being applied to the underside of the ABS lounger portion 16. A suitable reinforcing material can be fiberglass, as its position on the underside of the ABS is protected from the hot steam environment. The reinforcement 33 is applied to the underside of the lounger portion to: the small of the back area 19, the seat area 18 and under the raised foot portion 17. Typically, about 6 mm of fiberglass is added as reinforcement.

The inside of the ABS base tub 12 is similarly reinforced with fiberglass, providing a strong structure and yet a durable ABS finish on the outside (not detailed.)

The topside of the lounger portion 16 is an ergonomically designed seat allowing for the most relaxed sitting position. While prior art cabinets have the user sitting bolt upright on bench-style chair, the lounger portion 18 seat area is designed to allow maximum relation for stress relief. If the user falls asleep, his or her head lies gently against the back 19 of the lounger portion rather than snapping forward.

Armrests 34 are formed into the side walls 20 so that user with back or hip problems can support and align themselves.

A raised foot grid 35 of ribs at the foot 17 of the lounger portion 16 lifts the user's feet off of base assembly 21 where condensation collects and allows a warm circulating environment under the feet (See FIG. 8*b*).

Once the reinforcement to the lounger portion 16 and base tub 12 are applied, the liner tub 13 could be inserted into the base tub 12, however, there are additional enhancements associated with the liner tub 13 before it is so assembled.

In the prior art cabinets, generated steam rises from a pan boiler or is blown out a nozzle with no care for uniformity in cabinet temperature. As the steam heat rises it is common in prior art cabinets for head and chest temperature to be up to 20 degrees F. hotter than the foot temperature.

To ensure proper circulation of the steam provides uniform temperature throughout the cabinet, recirculation fans are provided. One or more U-conduits 40 are installed to the lounger portion 16 for drawing in steam environment from the steam enclosure 15 at one location 40*a* along the lounger portion 16 and ejecting it at another location 40*b*. To provide steam movement in the cabinet 10 is usually sufficient, however, an up to down recirculation is preferred. Two low voltage fans 41 are placed in-line in the U-conduits 40 for circulating steam and evening-out the temperature in the steam enclosure 15. Through active recirculation of the steam, the user is able to withstand more intense steam, will not get cold feet and the potential for hotspots is reduced.

Referring to FIGS. 6,7,8*a* and 8*b*, hot steam is conducted from the steam inlet 30 located anywhere in the base tub 12 and is directed through a steam connection or external steam conduit 42*b* to the foot 17 of the base tub 12. An internal steam conduit 42*a* within the base tub conducts steam to a steam conducting hollow structure or horn 44. The horn 44 projects upwardly and is located between the user's feet. The horn 44 is fitted with a plurality of steam outlets 45 for directing the steam forwards, away from the user's feet and towards the foot 22 of the lid 14. The steam is deflected back from the lid 14 into the enclosure 15 and can move laterally and upwardly from the lid and thus be diluted in the steam environment, lessening any hot spots before contacting the user.

A temperature probe 46 is provided further in the enclosure, which is tied into a safety interlock with the steam supply. Once each of the steam conduit 42 to the horn 44, the U-conduit 40 and fans 41, and the temperature probe 46 are installed into the liner 13 and base tubs 12 they are assembled together to form the base assembly 21.

The liner tub 13 has a peripheral edge 23*a* that is matched to the peripheral edge 23*c* of the base tub 12. The liner tub's 13 peripheral edge 23*a* overlaps the base tub's peripheral edge 23*c*. Once assembled the liner 13 and base tubs 12 are foamed together with foamed-in-place insulation through a suitable access port formed through the base tub. The foam insulates, covers and fixes the steam conduit 42 and fan 41, temperature probe 46 and control wiring in place. A bead of sealant, such as silicone, is run about the interface of the two peripheral edges 23*a*, 23*c*.

Once assembled, a stainless steel hinge 24 is riveted to the lid 14 and to the foot 17 of the base assembly 21.

Steam Generator

A common problem with all portable steam generating systems is that in order to achieve a desirable 30-minute steam experience, it generally takes 7–12 minutes for preheating. This preheat time is a function of the large water volume that must be raised from room temperature to steam-generating temperature through the use of electrical heating elements. In addition to the perceived deterrent to use because of the extra inconvenience the preheat causes, this delay also causes significant downtime when used in a commercial application. Faster heat time of this large volume of water is not achievable within the constraints put on heater size by a standard 110V, 15A electrical circuit.

Figure 9:
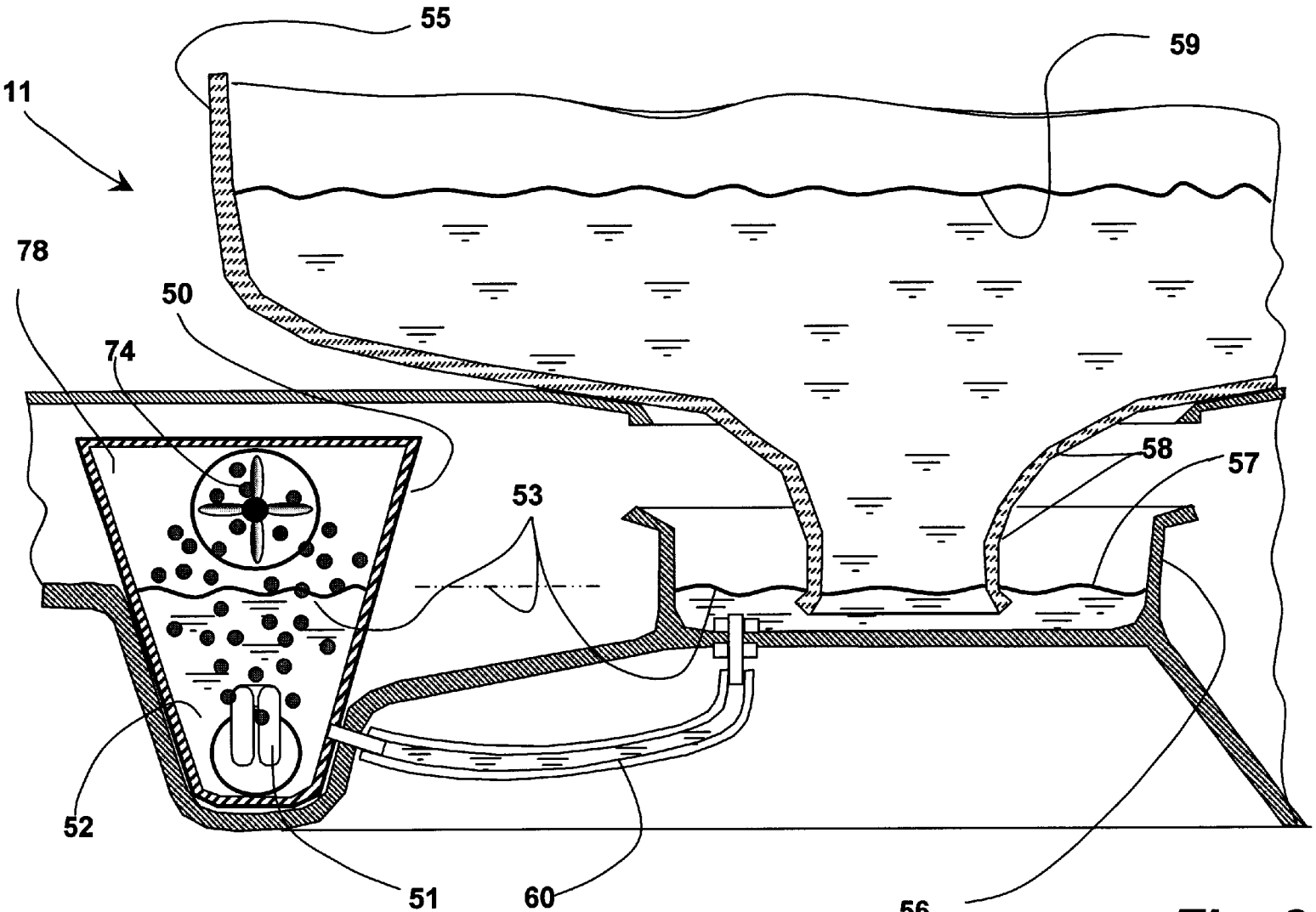
FIG. 9 is a partial cross-sectional view of the boiler and gravity feed water supply of the portable steam generator.
Figure 10:
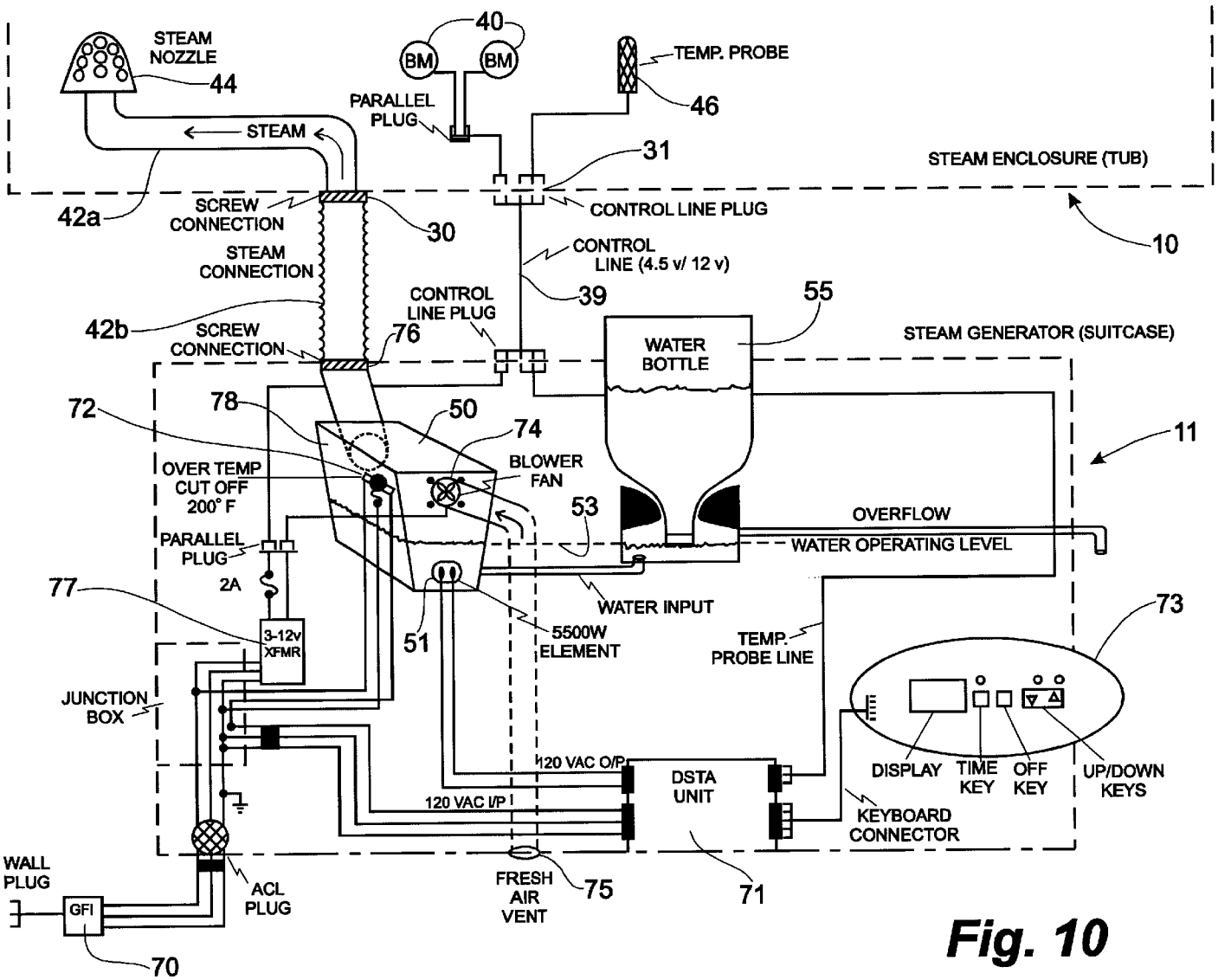
FIG. 10 is a schematic of the boiler water system and the electrical and control system for the portable steam generator.

Accordingly, and having reference to FIGS. 8*a*, 9 and 10, a new portable steam generator 11 is provided utilizing a new boiler 50 which reduces pre-heat time to approximately 3 minutes in two ways. First, the design of the V-shaped boiler 50 design minimizes the amount of water required to submerge heating element 51 positioned in the narrow bottom or apex 52. A minimum level 53 of water is maintained in the boiler 50 which just covers the heating element 51. Accordingly, the volume of water required to cover the element 51 is significantly reduced over the prior art boilers holding an entire water supply. A further 22% reduction in volume is achieved using the V-shape compared to a rectangular design prior art boiler.

Secondly, a water reservoir 55 operates as part of a vacuum trickle drip system which feeds water slowly to the heater 50 only as it evaporates. This means that the maximum water level is also close to the minimum water level 53 throughout the steam cycle. Prior art portable, non-plumbed steamers utilize a one-time fill, which has the water level starting out much higher than at the end of the reservoir capacity.

The trickle drip system allows a user to fill or provide a commercial bottled water feed reservoir 55 suitable for multiple steam applications, allows the user to visibly see when refill is required, makes the refill process easy, and keeps the water level as an optimal minimum level 53 at all times.

Further, by keeping the water level at the minimum level 53 it helps minimize preheat time. Additionally, the trickle system keeps the water level in the boiler constant, which in turn keeps the steam temperature constant.

As shown in FIG. 8*a*, the cabinet 10 is connected to the portable steam generator 11. A steam conduit 42*b* extends from the steam generator 11 to the cabinet's steam inlet 30. Further, a low-voltage control line 39 extending from the steam generator 11 and cabinet 10 conducts power to the recirculation fan 40, or fans, and the signal back from the temperature probe 46 to the steam generator 11. The water bottle reservoir 55 is shown in place over the steam generator 11.

Referring again to FIG. 9, the trickle system comprises the V-shaped boiler 50, the water reservoir 55 and a dish 56 forming a water pool 57. The boiler's V-shaped apex 52, or constricted volume of the boiler 50, minimizes the volume and mass of water which must be heated to form steam. The electric immersion heater 51 is positioned low the apex 52.

The water reservoir 55 has a neck portion 58 is shown projecting into the pool 57. Water is gravity fed from the water reservoir 55 into the pool 57. Water replenishes the pool 57 as soon as the water level 53 drops sufficiently to break the vacuum in the reservoir 55 and allow air back in. In this way the level 53 in the pool 57 is closely controlled, regardless of the water level 59 in the reservoir 55.

The water pool 57 is conducted through a conduit 60 to the boiler 50. The water level in the pool 57 is maintained at the minimum water level 53 in the boiler 50.

Turning to FIG. 10, a 110 v, 15A line 70 is fed to power distribution and control module (DSTA) 71. An over temperature power cutout 72 (190–200° F.) interrupts the power to the DSTA 71 in over-temp situations. The DSTA 71 monitors the temperature probe 46 from the cabinets, accepts programming control (such as time and temperature set points) from a control panel 73 and outputs various characteristics, including temperature to a control panel display. The DSTA 71 controls the boiler's heater 51 powered by a 5500 W electric element.

The boiler 50 further comprises a boiler fan 74, which draws fresh air through an air intake conduit 75, and forces generated steam in the freeboard area 78 through at outlet conduit 76 and steam connection 42*b* to the cabinet 10. A 110V AC to 4.5V DC (or 12V—depending on the fans) power supply 77 is provided which operates the boiler fan 74 and also powers the steam recirculation fans 40 through the cabinet control line 39.

The embodiments of the invention for which an exclusive property of privilege is claimed are defined as follows:

1. A personal steam cabinet comprising:

a) a base tub having a first periphery about a cavity:

b) a liner tub forming a steam enclosure and having a generally W-shaped, body-contoured inside lounge portion defining a foot area, a seat area, a back area and side walls, the lounge portion fitted with one or more U-shaped steam conduits, each having a outlet and an inlet communicating with the enclosure, the liner tub being insertable into the cavity in the base tub and having a second periphery which mates and seals to the base tub's first periphery when so inserted so as to form a base assembly having a foot and a head;

c) means for inducing flow through each U-shaped steam conduit to recirculate steam in the enclosure;

d) a steam supply conduit extending from the base tub and to the lounge portion for conducting and discharging steam into the enclosure; and e) a closable lid having a third periphery which mates with the second periphery when the lid is closed and substantially sealing the enclosure, the lid having a foot and a head adjacent the foot and head of the base assembly respectively, the lid's head having a cutout for permitting passage of a user's head.

2. The personal steam cabinet of claim 1 further comprising:

a) a hinge connecting the foot of the lid and the foot of the base assembly; and b) means for restricting the maximal opening of the lid to about a vertical position.

3. The personal steam cabinet of claim 2 wherein the lounge portion further comprises a steam discharge adjacent the lounge's foot, the steam being directed towards the lid.

4. The personal steam cabinet of claim 2 wherein the lid and liner tub are formed of ABS.

5. The personal steam cabinet of claim 4 wherein the liner tub is fiberglass reinforced, the fiberglass reinforcement being isolated from the steam enclosure.

6. The personal steam cabinet of claim 5 wherein the base tub is formed of ABS and is fiberglass reinforced, the fiberglass reinforcement being located on the cavity side of the base tub.

7. The personal steam cabinet of claim 6 wherein the base tub and liner tub are sealed at their respective first and second peripheries.

8. A personal steamer comprising:

a) a liner tub inserted into a base tub for forming a base assembly having a foot and a head, the liner tub forming a steam enclosure and having a generally body-contoured topside lounge portion, the lounge portion having an underside fitted with one or more U-shaped steam conduits and a fan for inducing flow through each U-shaped steam conduit to recirculate steam in the enclosure;

b) a steam supply conduit extending between the base tub and the liner tub for conducting steam into the enclosure;

c) a closable lid having a lid periphery which mates with a base periphery formed about the base assembly for substantially sealing the enclosure, the lid having a foot hinged to the foot of the base assembly and having a cutout for permitting passage of a user's head; and d) a portable steam generator connected to the steam supply conduit, the generator having a boiler with a heater immersed in a shallow, level-controlled water supply, the level of the water supply being controlled using a gravity fed, vacuum-locked water reservoir and a fan for directing the steam to the steam supply conduit.

9. The personal steamer of claim 8 wherein the liner tub is manufactured of ABS and the underside of the liner tub is reinforced with fiberglass.

* * * * *